United States Patent [19]

Liebl

[11] 3,935,453

[45] Jan. 27, 1976

[54] QUADRUPOLE FIELD MASS ANALYSER

[75] Inventor: Helmut Liebl, Eching, Germany

[73] Assignee: Max-Planck-Gesellschaft zur Forderung der Wissenschaften e.V., Germany

[22] Filed: Sept. 17, 1974

[21] Appl. No.: 506,707

[30] Foreign Application Priority Data

Sept. 24, 1973 Germany ..... 2347946

[52] U.S. Cl. ..... 250/292

[51] Int. Cl.[2] ..... H01J 39/34

[58] Field of Search ..... 250/292, 285, 282, 283

[56] References Cited

UNITED STATES PATENTS 2,939,952 6/1960 Paul et al. ..... 250/292

*Primary Examiner*—James W. Lawrence
*Assistant Examiner*—T. N. Grigsby
*Attorney, Agent, or Firm*—Brisebois & Kruger

[57] ABSTRACT

A mass spectrometry apparatus, a quadrupole field mass analyser, is disclosed together with a novel method of investigating ions in or for mass spectrometry. The apparatus and method employ multiple-channel quadrupole mass filter devices to which the ions are fed via a relatively large entry aperture afforded preferably by a transverseley-split spherical or cylindrical capacitance analyser arranged in conjunction with a stop aperture device to remove ions having energies which are not within a predetermined energy band. The ions are accelerated into the first half of the capacitance analyser, decelerated to pass into the filter devices, and then reaccelerated to the ion detection device.

9 Claims, 5 Drawing Figures

52
U1
50
48
46
42
40
rm
Z
39
36
38
37
16
U1/2
32
34
28
r1
18
Z1
30
22
Ø
20
26
U1
24
12

QUADRUPOLE FIELD MASS ANALYSER

This invention relates to quadrupole field mass analysers.

Quadrupole mass filters, for example those disclosed in the publication by W. Paul and H. Steinwedel, z.Naturforsch. 8*a* (1953) 448–450, are distinguished by their simple construction as compared to mass spectrometers operating with magnetic fields. They are frequently used for performing surface and solid state analysis by means of secondary ion emission or sputtering, and mass analysis of the secondary ions.

The ions pass through the quadrupole mass filter without any loss only when these ions are emitted from the ion source within a small solid angle about the axis of the quadrupole mass filter, and if the entry energy of the ions does not exceed a certain value. In fact, ions having excess energy traverse the quadrupole mass filter too quickly in order to be able to perform the necessary number of oscillations in the quadrupole field to experience a satisfactory separation on the basis of mass.

The emission distribution of secondary ions detached by sputtering follows approximately a cosine law the average energies lying between 5 eV and 30 eV. This latter value corresponds approximately to the maximum energy at which quadrupole mass filters of handy length are still able effectively to separate on the basis of mass. That portion of the ions possessing higher energies must be removed by an energy filter, consisting in general of an electrostatic deflecting field arranged either before or following the mass filter.

It is an object of the present invention to provide a quadrupole field mass analyser for ions possessing markedly different amounts of energy, the analyser having a substantially higher entry aperture and therefore also a correspondingly higher detection sensitivity than is possessed by the known types of quadrupole field mass analysers.

Accordingly, the invention provides a quadrupole field mass analyser comprising first electrode means for accelerating ions to be analysed, an annular entry slot for said ions, second electrode means for deflecting the ions coming through said entry gap into the form of a hollow parallel beam of annular cross-section, third electrode means for sub-dividing the hollow beam of ions into a plurality of component ion beams and for focussing said component ion beams in a plane substantially normal to their direction of travel, an energy diaphragm which passes only ions whose energies lie within a predetermined energy range, a plurality of sets of quadrupole field electrodes aligned with respect to the component ion beams and an ion detecting means for detecting ions emerging from the quadrupole fields.

In the following there will be explained in more detail a practical example of the invention with reference to the accompanying drawing, in which:

FIG. 1 shows schematically a simple quadrupole mass filter with four electrodes, *a*, *b*, *c*, and *d* of rod or cylinder shape, which are distributed symmetrically about an axis 10. Each pair of opposite electrodes *a*, *b*, and *c*, *d* respectively are connected together to opposite poles of a source of high frequency voltage V and a unidirectional voltage U.

From the theory of the quadrupole mass filter one can derive the following expressions for the high frequency voltage V, the unidirectional voltage U, and the high frequency power P:

$$V = k_1 M f^2 r_o^2 \quad (1)$$

$$U = k_2 V \quad (2)$$

$$P = k_3 C M^2 f^5 r_o^4 \quad (3)$$

In the above:

$k_1$, $k_2$ and $k_3$ are apparatus constants, $M$ is the effective mass transmitted by the mass filter, $f$ is the frequency of the high frequency voltage $V$, $C$ is the capacitance of the one pair of electrodes $a$, $b$ with reference to the other pair of electrodes $c$, $d$, $r_o$ is the spacing of the electrodes from the axis.

The ions of mass $M$ pass through the mass filter only without loss if they enter within a definite acceptance region about the axis 10 of the quadrupole field. The acceptance region is defined by a surface of circular section having a radius $r_e$, which must be traversed by the ions, and a limiting angle of inclination $a_e$ of the path of the ions with reference to the axis.

Figure 1:
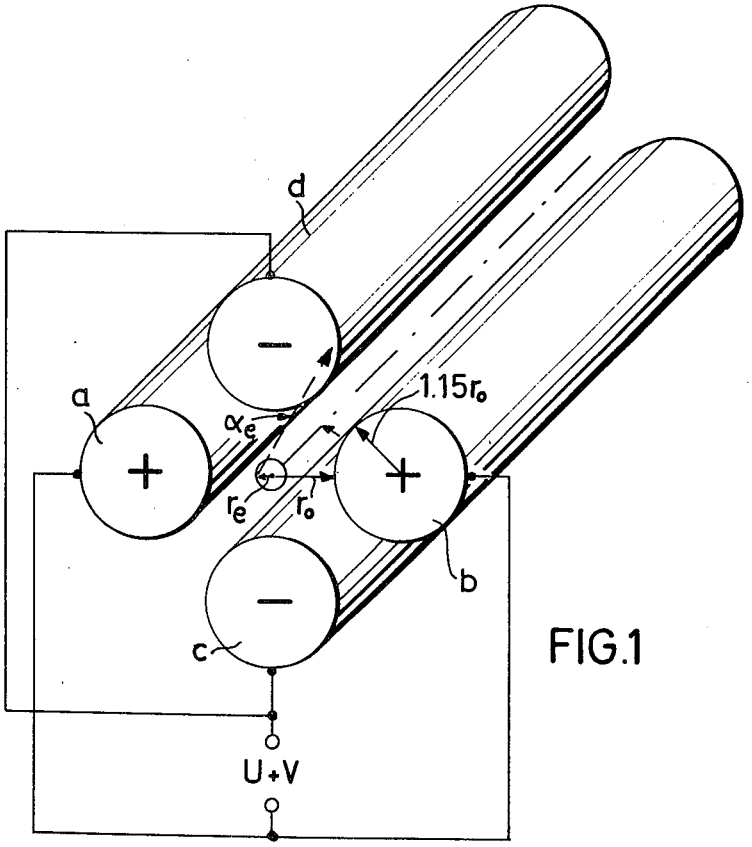
FIG. 1 is a schematic perspective view of an electrode assembly of a simple prior art quadrupole mass filter.
Figure 2:
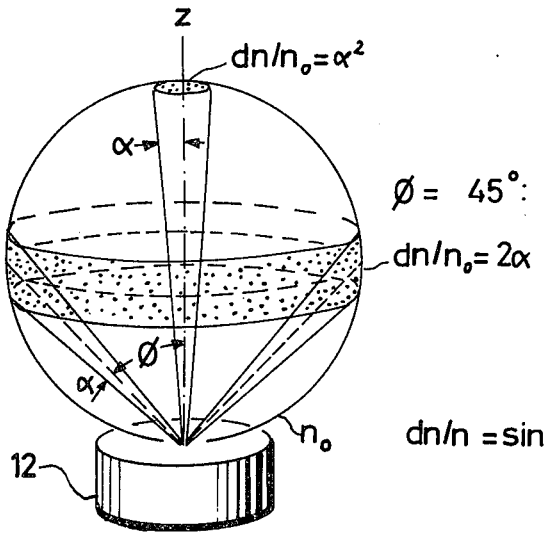
FIG. 2 is a diagram for explaining the acceptance relationship in the known quadrupole mass filter and the quadrupole mass analyser according to the invention.

With reference to FIG. 2 there will now be investigated the conditions obtained at the surface of a sample 12 from which, by means of a fine beam of primary ions, secondary ions are released whose mass is to be determined. The emission distribution of the detached ions follows approximately a cosine law as is represented in FIG. 2. The secondary ion stream coming from the sample surface amounts to $n_o$ ions per second. Only a small proportion of these $dn/n_o = \alpha^2$ come into the solid angle about the normal $z$ taken at the surface of the sample and bounded by a right cone having a small apex angle $\alpha$. This is the fraction of the emission which is capable of being focussed under conditions of optimum matching into the acceptance region of the quadrupole mass filter represented in FIG. 1 (e.g. $dn/n_o = 1/400$ for $a = 2.9°$). An increase in the analysed ion current in the arrangement according to FIG. 1 is possible only by increasing the acceptance, i.e. by increasing $r_o$. According to equations (1) and (2) the required voltages increase in proportion to $r_o^2$, so that the field strength at the electrodes therefore increases with $r_o$. Any increase of the acceptance region by increasing $r_o$ will very soon encounter a limit imposed by the breakdown field strength.

If one now considers the solid angle, which corresponds to a hollow cone having a mean apex angle of $\phi$ the result is a fraction $dn/n_o = 2 \sin 2\phi \cdot \alpha$.

For $\phi = 45°$, this gives $dn/n_o = 2\alpha$. For the above stated value $\alpha = 2.9°$, the value of $dn/n_o = 1/10$, that is to say 40 times the above stated value.

In the quadrupole field mass analyser according to the invention, an increase of the transmission, and therefore of the sensitivity with simultaneous limitation of the energy range of the ions is achieved by the use of an annular entry slot corresponding to the conditions explained with reference to FIG. 2, and the incoming hollow ion beam is distributed over a plurality of quadrupole fields, which are arranged in parallel connection equidistant from a central axis. In this case certain electrodes are simultaneously employed for the production of two adjacent electrical quadrupole fields.

The energy limitation (energy filtering) is effected by an electrostatic deflecting field in combination with a suitable disphragm ("energy diaphragm"), which only admits the ions of a desired energy range. Preferably the energy filter which is used is an energy analyser of a halved cylindrical mirror analyser type symmetrical about a central axis of rotation (see for example H. Z. Sar-el, Rev.Sci.Instr. 38 (1967) 1210–1216), in which the ions are emitted by the sample within a hollow conical shell and pass through the entry diaphragm, these ions being so deflected that they leave the energy analyser upon paths, which are substantially parallel to the central axis. By means of an arrangement of lenses, these ions are then focussed upon the entry region of the individual quadrupole fields corresponding to the respective radius $r_e$ (FIG. 1).

The ions of the selected effective mass M admitted by the parallel connected quadrupole fields can then be detected by a suitable number of individual detecting arrangements, by a detecting arrangement of large surface area, or preferably by a single detecting device upon which the various bundles of ions are focussed.

Instead of using the bisected cylindrical mirror analyser it is also possible to use a spherical condenser (see for example E. M. Purcell, Phys. Rev. 54 (1938) 818).

Figure 3:
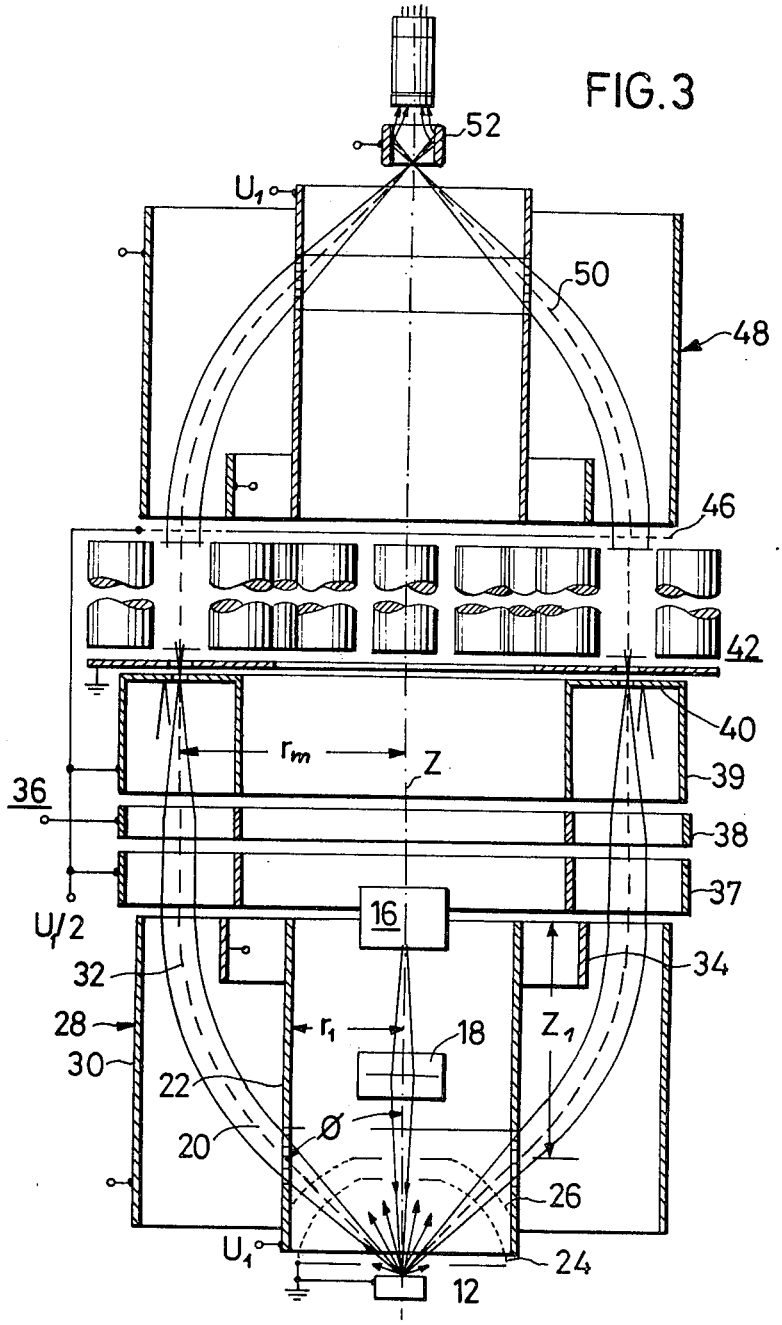
FIG. 3 is a simplified shortened axial section of a quadrupole field mass analyser according to one constructional example of the invention.
Figure 4:
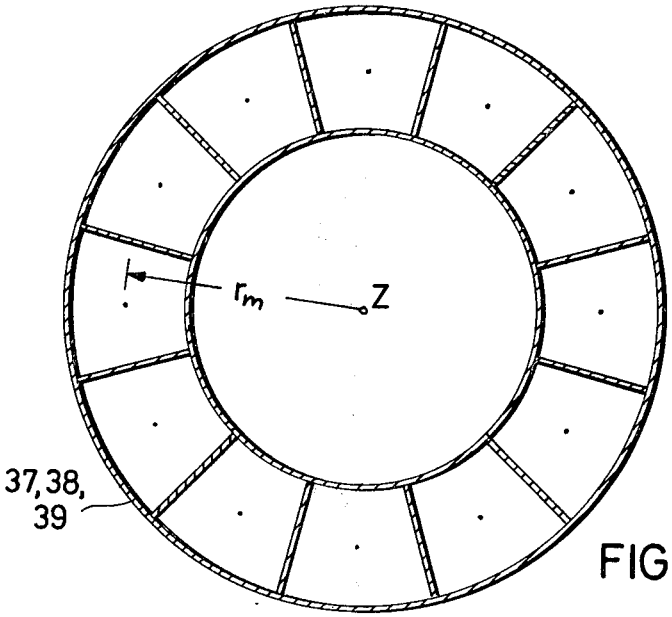
FIG. 4 is an axial view of an electrode of an electrostatic sector lens, which can be employed in the quadrupole field mass analyser according to FIG. 3.
Figure 5:
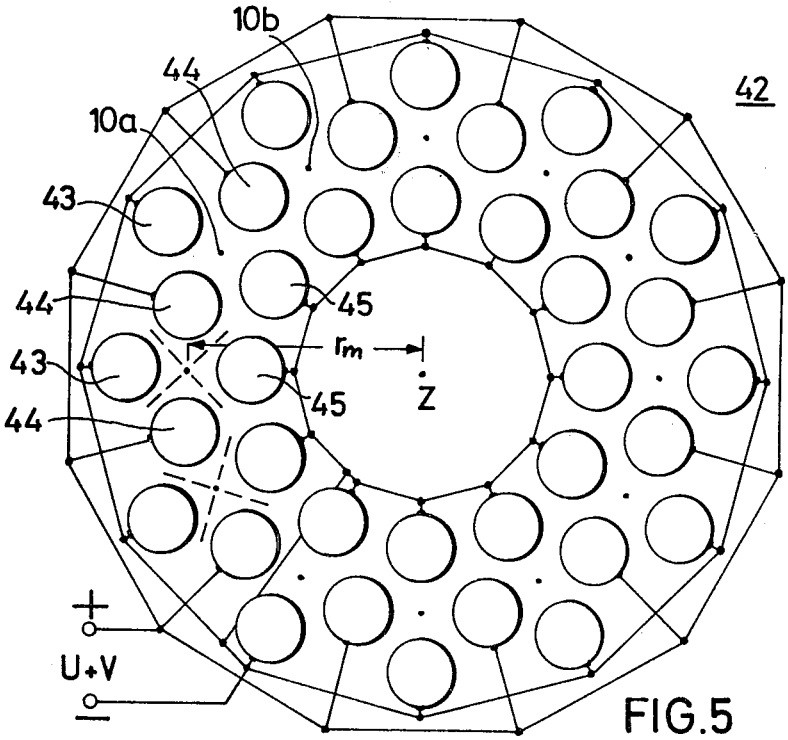
FIG. 5 is an axial view of an electrode arrangement for producing a plurality of quadrupole fields, which are traversed in parallel by the ions which are to be analysed.

In the practical example of the invention represented in FIGS. 3 to 5, the sample 12 is bombarded with a beam of primary ions, which is generated by means of a primary ion source 16 and an associated focussing arrangement 18. The secondary ions sputtered from the surface of the sample 12, connected to earth, within a hollow cone having a mean apex angle $\phi = 45°$, are reaccelerated by an amount $eU_1$ through an electrical field between hemi-spherical grids 24, 26 concentric to the emission region of the sample 12, and these secondary ions then pass through an annular entry slot 20 in a cylindrical inner electrode 22 of a cylindrical mirror analyser 28. Between the inner electrode 22 and the outer electrode 30 of the cylindrical mirror analyser there is set up an electrostatic field, in which the hollow ion beam 32 is deflected forward so that the ions leave the cylindrical mirror analyser as a hollow beam of annular cross-section substantially parallel to the axis $z$. The radius $r_1$ of the inner electrode is 0.516 $r_m$ ($r_m$ = the radius from the axis to the centre of the axially parallel hollow beam, and the axial distance $z_1$ amounts to 1.08 $r_m$ measured between the centre of the ion beam at the position of the entry slot 20 and the exit plane at the end of the cylindrical mirror analyser 28. At the exit end the cylindrical mirror analyser contains a relatively short, thin walled, cylindrical metal electrode 34, which has the same distance from the hollow beam as the outer electrode 30, and possesses a potential $U_2$, which potential will exist at this radius without the presence of the said electrode. In this way the stray field at the exit end of the ion beam is maintained small.

Connected to the cylindrical mirror analyser 28 is an electrostatic lens 36 comprising three electrodes 37, 38 and 39 having the cross section represented in FIG. 4. The lens is therefore symmetrical about the axis and consists of a plurality of sectors, numbering twelve in the example here shown. By means of the lens 36 the cylindrical hollow beam is divided into a number of component beams corresponding to the number of sectors and these are focussed into a plane perpendicular to the axis $z$, in which there is situated an energy diaphragm with a circular opening, or a number of individual openings, for example circular openings, corresponding to the number of sectors, and so dimensioned that ions are only admitted whose energy lies within the permitted energy range. Ions possessing energy in excess of this amount are focussed at positions having a greater spacing than $r_m$ (FIG. 4) from the central axis $z$ and are therefore not able to pass through the diaphragm aperture, or apertures. By suitable choice of the voltage $U_1$, the energy dispersion can be so adjusted that only ions having an energy below the permissible maximum for full mass separation can pass through the energy diaphragm 40.

The ion stream consisting of bundles of ions coming from the energy diaphragm 40, which now contain only ions having the acceptable energy, now pass into an electrode arrangement 42, which allows the formation of a number of quadrupole fields equal to the number of ion bundles. The electrode arrangement 42 comprises axially parallel round rods of dimensions usual in quadrupole filters. The round rods are so arranged that there can be generated, at a spacing distance $r_m$ from the central axis $z$, a number of quadrupole fields equal to the number of ion bundles, whose axes 10*a*, 10*b*, and so on, are placed at a distance $r_m$ from the central axis $z$ and are aligned with the axes of the respective ion bundles. The manner of connection of the rod shaped electrodes is visible from FIG. 5. The rod shaped electrodes 43 having the greatest radial spacing from the central axis $z$ and the rod shaped electrodes 45 radially aligned with the latter and having the smallest radial spacing from the central axis $z$, are connected together and to the negative pole of the unidirectional voltage source, whilst the rod shaped electrodes 44 arranged at an intermediate radial spacing from the axis, and which in the circumferential direction are situated in gaps between the adjacent pairs of electrodes 43–45, are connected together and to the positive pole of the unidirectional voltage source. The rod shaped electrodes 44 connected to the positive pole each serve as a common electrode for two electrode sets situated adjacent each other in the peripheral direction, each of said sets serving for the generation of a quadrupole field.

Upon entering the quadrupole field mass filter constituted by the electrode arrangement 42, the ions are retarded to the initial energy which they possessed before being accelerated between the grid electrodes 24 and 26, and upon leaving the arangement 42 the ions having the transmitted effective mass are reaccelerated by means of a plane grid electrode 46, so that proceeding in paths approximately parallel to the $z$ axis they enter a second cylindrical mirror analyser 48, which is constructed in an analogous manner to the cylinder mirror analyser 28 and which serves to deflect the selected ions admitted by all of the quadrupole channels through an exit gap in the inner cylindrical electrode of the cylindrical mirror analyser 48 into a single ion detection device 52 arranged on the $z$ axis.

The ion detecting device can be in the form of a simple collector, or a secondary emission electrode with a following secondary electron multiplier, or, as shown in simplified form in FIG. 3, it can be a tubular ion-electron converter with a following scintillator and photomultiplier (see for example J.Vac.Sci. Techn.8 (1971) 384–387).

By the use of the described arrangement it is possible when practising surface or solids analysis by means of secondary ions and the use of quadrupole mass filters, to achieve, as compared with previously conventional arrangements, an increase in the transmission, and therefore in the sensitivity, by between 1 and 2 orders of magnitude. The presently described quadrupole field mass analyser can also serve for the analysis of sputtered neutral particles if these are ionised by an electron stream in the field-free space between the sample 12 and the grid electrode 24.

Numerical Example

Application: Analysis of positive secondary ions having a means initial energy $eV_o = 10\ eV$.

Cylindrical Mirror Analyser 28

Dimensions: $\phi = 45°$; $r_m = 5.0$ cm; $r_1 = 2.58$ cm; $z_1 = 5.4$ cm; $r(34) = 6.0$ cm; $r(30) = 4.0$ cm.

Voltages: $U_1 = -500$ V; U(34) = −335 V; U(30) = −180 V.

Lens 36

Dimensions: Length 6 cm; inner and outer radius of the three electrodes (37, 38, 39) 3.7 cm and 6.3 cm.

Voltages: U(37, 39) = −250 V; U(38) variable from 0 to −250 V (fine adjustment).

Quadrupole Field Mass Filter 42

Dimensions: Length 20 cm; $r_m = 5.0$ cm; Diameter of the rod shaped electrodes (43, 44, 45) = 14.3 mm; Spacing ($r_o$) from the axis (10*a*, 10*b*) = 6.22 mm.

Voltages: Unidirectional voltage U variable from 0 to 1000 V; High frequency voltage V, 2 MHz, variable from 0 to 6 kV; coupled variation of U and V so that in all cases U/V = 0.168; mass range up to 260.

I claim:

1. A quadrupole field mass analyser comprising first electrode means for accelerating ions to be analysed, an annular entry gap for said ions, second electrode means for deflecting the ions coming through said entry gap into the form of a hollow parallel beam of annular cross-section, third electrode means for sub-dividing the hollow beam of ions into a plurality of component ion beams and for focussing said component ion beams in a plane substantially normal to their direction of travel, an energy diaphragm which passes only ions whose energies lie within a pre-determined energy range, a plurality of sets of quadrupole field electrodes aligned with respect to the component ion beams, and an ion detecting means for detecting ions emerging from the quadrupole fields.

2. A quadrupole field mass analyser according to claim 1, in which the axes of the sets of quadrupole field electrodes lie upon a circle and in which one electrode is common to each two sets of adjacent quadrupole field electrodes.

3. A quadrupole field mass analyser according to claim 1, in which the third electrode means comprises an electrostatic lens with sector shaped electrodes.

4. A quadrupole field mass analyser according to claim 1, in which the energy diaphragm is arranged at the focal plane of the third electrode means.

5. A quadrupole field mass analyser according to claim 1, further including fourth electrode means for deflecting the ions emerging from the quadrupole fields towards a single ion detecting means.

6. A quadrupole field mass analyser according to claim 1, in which the second electrode means comprises a bisected cylindrical mirror analyser.

7. A quadrupole field mass analyser according to claim 6, in which at the end of the cylindrical mirror analyser adjacent the sets of quadrupole field electrodes there is arranged a short cylindrical auxiliary electrode which has the same radial spacing from the hollow ion beam as an outer cylindrical electrode of the cylindrical mirror analyser.

8. A quadrupole field mass analyser according to claim 6, in which the annular entry gap is formed by a gap in a cylindrical inner electrode of the cylindrical mirror analyser.

9. A quadrupole field mass analyser according to claim 1, in which the first electrode means comprises two hemi-spherical net electrodes.

* * * * *